US008042323B2

(12) United States Patent
Artzt et al.

(10) Patent No.: US 8,042,323 B2
(45) Date of Patent: Oct. 25, 2011

(54) METHOD AND APPARATUS FOR SPINNING STAPLE FIBRES ON RING-SPINNING MACHINES

(75) Inventors: Peter Artzt, Reutlingen (DE); Jurgen Schneider, Rottweil (DE); Uwe Heitmann, Goppingen (DE)

(73) Assignee: Deutsche Institut fur Textil-und Faserforschung Denkendorf, Denkendorf (DE)

( * ) Notice: Subject to any disclaimer, the term of this patent is extended or adjusted under 35 U.S.C. 154(b) by 145 days.

(21) Appl. No.: 12/528,891

(22) PCT Filed: Feb. 18, 2008

(86) PCT No.: PCT/EP2008/051928

§ 371 (c)(1),
(2), (4) Date: Aug. 27, 2009

(87) PCT Pub. No.: WO2008/104471

PCT Pub. Date: Sep. 4, 2008

(65) Prior Publication Data

US 2010/0043380 A1 Feb. 25, 2010

(30) Foreign Application Priority Data

Feb. 28, 2007 (DE) ..... 10 2007 010 144

(51) Int. Cl.
*D01H 7/52* (2006.01)

(52) U.S. Cl. ..... 57/75

(58) Field of Classification Search ..... 57/58.49, 57/75, 408, 417

See application file for complete search history.

(56) References Cited

U.S. PATENT DOCUMENTS

| | | | | |
|---|---|---|---|---|
| 2,198,020 | A | 4/1940 | Weinberger | |
| 3,813,869 | A | 6/1974 | Misaki | |
| 3,834,147 | A * | 9/1974 | Havranek et al. | 57/417 |
| 4,665,687 | A * | 5/1987 | Ott et al. | 57/417 |
| 4,702,069 | A * | 10/1987 | Maximov et al. | 57/417 |
| 5,423,177 | A * | 6/1995 | Raasch | 57/417 |
| 5,675,965 | A * | 10/1997 | Mackey et al. | 57/417 |
| 5,901,542 | A * | 5/1999 | Dinkelmann et al. | 57/75 |
| 6,035,625 | A * | 3/2000 | Schlomer et al. | 57/417 |
| 6,886,322 | B2 * | 5/2005 | Weide et al. | 57/404 |
| 7,065,951 | B2 * | 6/2006 | Baur | 57/417 |

FOREIGN PATENT DOCUMENTS

| | | |
|---|---|---|
| CH | 212174 | 11/1940 |
| DE | 196 29 787 A1 | 1/1998 |
| DE | 10306475 A1 * | 8/2004 |
| GB | 879038 | 10/1961 |
| GB | 1005744 | 9/1965 |
| WO | WO 2004/072339 A1 | 8/2004 |

OTHER PUBLICATIONS

PCT Search Report, May 21, 2008.
International Preliminary Report on Patentability, Oct. 8, 2009.
German Patent Office Search Report, Dec. 24, 2007.

* cited by examiner

*Primary Examiner* — Shaun R Hurley
(74) *Attorney, Agent, or Firm* — Dority & Manning, P.A.

(57) ABSTRACT

An apparatus and associated method for spinning staple fibers on a ring spindle machine includes a ring spindle disposed downstream of a drawing frame outlet. A thread guiding device is disposed between the drawing frame outlet and the ring spindle and includes a twisting apparatus that is magnetically coupled with the ring spindle so as to rotate at the same speed as the ring spindle. The twisting apparatus has a thread braking device configured along a path of the thread through the twisting apparatus. An attachment configured at a top of the ring spindle has a plurality of circumferential grooves configured to catch the thread coming from the twisting apparatus and being wound onto the ring spindle.

18 Claims, 2 Drawing Sheets

METHOD AND APPARATUS FOR SPINNING STAPLE FIBRES ON RING-SPINNING MACHINES

FIELD OF THE INVENTION

The invention refers to a method for spinning staple fibers, especially short staple fibers on ring-spinning machines, wherein a staple fiber composite is drawn into a drawing frame and twisted to form a thread. As it emerges from the driving frame, it is wound up by means of a traveler device. The fiber composite that emerges from the drawing frame runs through a thread-guiding device with a twisting apparatus equipped with a braking device driven in synchrony with the spindle to twist the fiber composite. In it also equipped with an apparatus for carrying out such method.

BACKGROUND

It is a well known fact that most of the time, threads in a ring-spinning machine break between the drawing device and the thread guide in the so-called spinning zone, where the slubbing coming out of the drawing device has not hardened so much that it can withstand every thread tension tip. In addition, the conventional thread guide—the so-called thread-guiding eyelet—allows only the partial twisting propagation of the traveler device in the spinning zone.

For several decades, textile engineers have made many suggestions for solving this problem: For example, it has been suggested to place so-called crowns on the ring spindle in order to make the twisting that originates in the traveler circling around the ring and moving towards the spinning triangle more effective and to achieve a better hardening of the slubbing coming out of the drawing frame in the critical zone (DE 1 116 584). In these spindle attachments, the thread places itself on the teeth of the crown and is taken along with them, but the yarn on the crown must make the same backward movement as the traveler on the spinning ring, which—correspondingly to the winding up motion and the winding up speed—remains back in the circumferential speed of the spindle. The thread is kept back in the crown tooth until the tension becomes so great that the thread jumps to the next tooth. Thus, the thread jumps backwards from tooth to tooth as the traveler remains behind. The resulting friction leads to undesired yarn damage and napping. Furthermore, each jump causes a tension jolt, which leads to an uneven twisting and integration of the fibers as they emerge from the drawing frame. Therefore, the aim is to use the fewest teeth possible. In the so-called spindle finger that is attached to the ring spindle, for example, there is only one tooth left. The smooth spindle finger causes less napping on the yarn, but it works virtually like a one-tooth crown through which the yarn is taken. This means that the jump is considerably greater, almost one turn, and this spindle finger solution causes considerable thread jolts, which in turn lead to thread breaks and an uneven yarn.

DE 196 29 787 A1 describes a rotating thread guide that has been placed as twisting apparatus between the usual thread guide above the spindle and the ring traveler directly above the ring spindle. Here, a turning body is taken from the spindle by means of a magnetic coupling.

The fiber composite is centrically introduced and led sideways out of the turning body, from which the fiber composite extends towards the ring traveler in one balloon. Alternatively, the turning body is supposed to have a helically-shaped channel and move slower or faster than the spindle independently from it. As a result of this, less false twist can be temporarily superimposed on the fiber composite.

The thread guide connected upstream, however, interferes with the generated twisting movement as it propagates towards the drawing frame. It has not been possible to introduce this known device in practice too because no defined twisting is imparted and the external impulse is too time-consuming.

To avoid these disadvantages, WO 2004/072339 has suggested placing a thread-guiding device with a twisting element at a certain distance above the upper end of the ring spindle and to couple this twisting element with the ring spindle via a magnetic force field. The twisting element has a thread-braking device that consists of a core—extending coaxially towards the twisting axis so the thread running through the thread-guiding device can wind around the core—and a catching edge arranged on the core. This design of the thread-guiding device can catch the thread and make it pass through the twisting element in a defined way so that the thread is imparted with a defined twist in the critical section between thread-guiding device and drawing frame. The winding up movement is done continuously and smoothly. This thread-guiding device has given outstanding results. In the critical section between drawing frame and thread-guiding device more than 100% of the twist is achieved in the thread F' before the spinning triangle relative to the desired twisting in the finished yarn. A jumping over crown teeth or something similar and the imponderable nature of a twisting caused by friction are no longer needed.

It was thus possible to increase the spinning revolutions significantly. The reduction in size of the spinning triangle and the improved binding of the threads achieved a significant quality improvement of the thread in addition to increased productivity. Even though the balloon diameter was reduced so much that balloon-constricting rings could be largely dispensed with, the higher spinning revolutions achieved with this design led to higher energy requirements. Furthermore, the coupling element placed on the spindle head for taking up the twisting element made the balloon larger and this caused higher balloon resistance and input.

The task of this invention is to lower the energy requirement in a thread-guiding device of this known type so higher production outputs can be achieved economically.

SUMMARY OF THE INVENTION

Objects and advantages of the invention will be set forth in part in the following description, or may be obvious from the description, or may be learned through practice of the invention.

Owing to the fact that the fiber composite emerging from the drawing frame runs through a thread-guiding device equipped with a twisting apparatus and this thread-guiding device is synchronously driven with the spinning twists, the fiber composite is twisted in this critical section as it moves towards the drawing frame exit so that a fully twisted and firm thread emerges from the twisting apparatus in such a way that, incredibly, the feared napping of the thread by a grooved spindle attachment does not occur. Now, the spindle attachment placed after the twisting apparatus suppresses the thread balloon so no high balloon tensile forces are generated. The air resistance that acts against the thread F is no longer needed, thereby achieving considerable energy savings.

The braking of the thread in the twisting apparatus prevents the jolts coming from the grooves of the spindle attachment to propagate in the twisting zone. This braking device makes it possible to maintain thread tension low and to allow the twist generated by the twisting element to be fully effective all the way to the spinning triangle. Since the thread friction generated by the attachment is negligibly low, an outstanding thread quality is generated in spite of a much higher spindle speed. With the utilization of the claimed method, it is possible to spin with twice the spinning speed but without any thread breaks and quality losses worth mentioning.

The attachment arranged on the ring spindle and placed downstream from the twisting element separates the twist insertion and the balloon suppression from each other. Each one of the two elements can be designed and optimized for its corresponding task. Surprisingly, it has been shown that the downstream placement of a spindle attachment after the twisting element according to the invention can achieve significant energy savings without affecting the yarn quality achieved by the twisting element of the thread-guiding device so that only through this combination the advantages of this thread-guiding device with a twisting element can be fully exhausted—namely, high productivity and quality with simultaneous energy savings, For taking the twisting element through the spindle, the attachment has a front part (placed at a certain distance from the twisting element) that contains a permanent magnet for creating a magnetic force field with a magnet that has the opposite pole for catching the twisting element. The attachment itself has a useful cylindrical surface area in which grooves extending all the way to the front part of the attachment have been foreseen so that they can easily grasp the threads corning out of the twisting element.

Owing to the centric exiting of the thread from the twisting element in front of the front part of the attachment, exact geometric conditions are ensured for a precise catching of the thread. The diameter of the attachment is the same as the spindle diameter that comes after the attachment so that the thread caught by it winds around easily and inevitably around the spindle and therefore no balloon forms. Several embodiments of the attachment are possible. For example, the diameter of the attachment can exceed the subsequent spindle diameter by the groove depth, but it is also practical and better for protecting the thread if the grooves with their groove bottom end on the subsequent spindle diameter. The separation of twisting and balloon suppression creates the advantage that in the execution of the spindle attachment the gentle grasping of the thread is the only thing that must be heeded.

Owing to the exactly predefined geometry of the run of the thread, it is not necessary for the grooves to extend over the entire length of the surface area of the attachment. It has been shown to be advantageous and practical to furnish the attachment with a grooved ring protruding from the shaft diameter of the attachment on its end that faces the thread-guiding element. The orientation and length of the grooves have been adjusted to the geometry of the run of the thread. For a good catch, it suffices if the grooves intersect the ring edge created by the front part and the surface area at an angle $\alpha$.

To prevent large jumps and therefore jolts in the thread, the number of grooves should be large if possible. It has proven useful to adjust the width of the grooves to about double the yarn diameter. The depth of the grooves is about one-half of the width of the groove, thereby ensuring not only a slight catching of the thread but also a good thread release in the next groove without excessive strains and strain jolts. In this way, the quality of the thread is not affected.

BRIEF DESCRIPTION OF THE DRAWINGS

More details of the invention are explained with the help of drawings, which show.

DESCRIPTION

Figure 1:
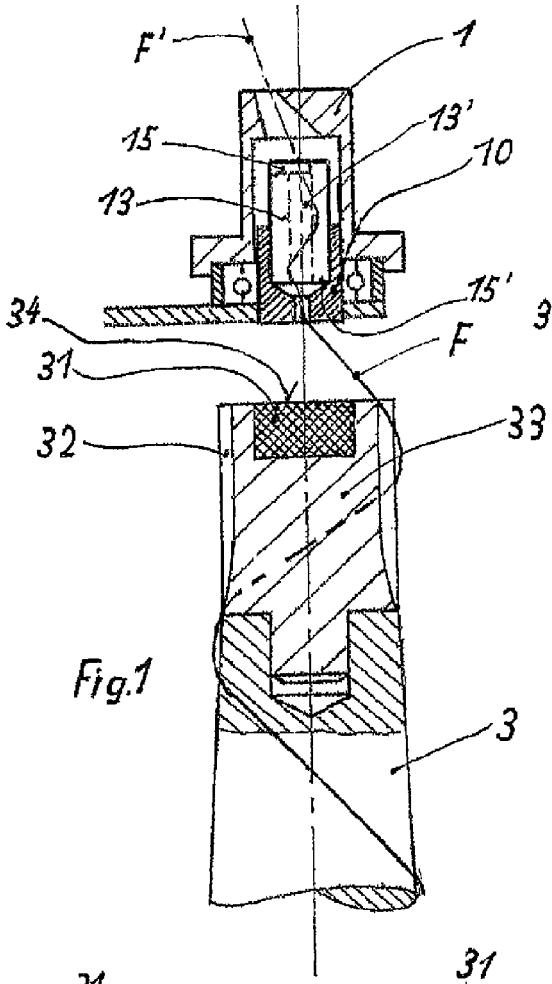
FIG. 1 the twisting element with the spindle attachment placed downstream.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The thread-guiding device consists of a thread-guiding device 1 arranged over the spindle with a twisting element 10 containing a braking device. This braking device consists of a tappet 13 with a core 13' extending coaxially with regard to the turning axis around which a thread F still unfinished at the top emerges from the spindle 3 to the drawing frame outlet. An upper edge 15 and a lower edge 15' have been foreseen for this core 13' on which the thread F running through the thread-guiding device 1 rests and is taken along when the twisting element 10 turns.

The part of the twisting element 10 that faces the spindle 3 has been executed as a magnet and forms a magnet coupling with the attachment 33 of the spindle 3, which is also equipped with a permanent magnet 31 so that the twisting element 10 rotates with the same speed as the spindle 3. It is known that the distance from the spindle attachment 33 to the twisting element 10 is determined by the magnetic field necessary for ensuring the twisting element 10 to be taken through the spindle 3. Generally, this distance is about 5 to 10 mm.

Figure 2:
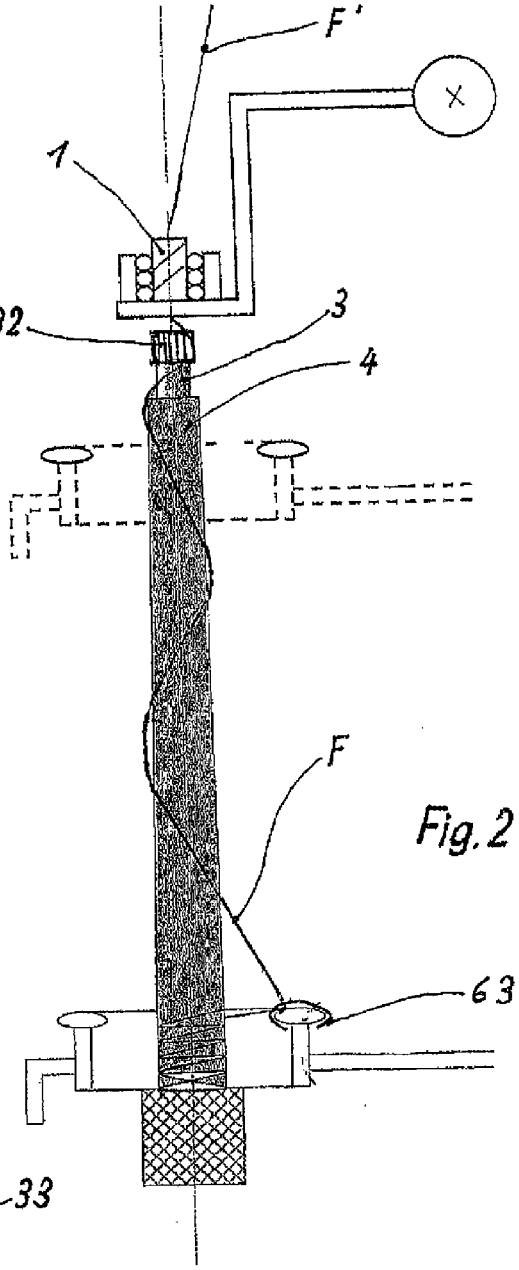
FIG. 2 an overall arrangement of the spindle with spindle attachment and twisting element.
Figure 3:
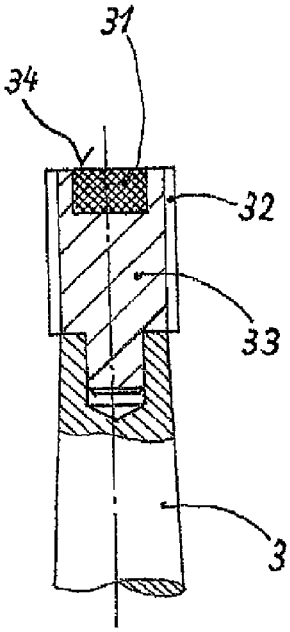
FIGS. 3 and 4 several different embodiments of the spindle attachment.
Figure 4:
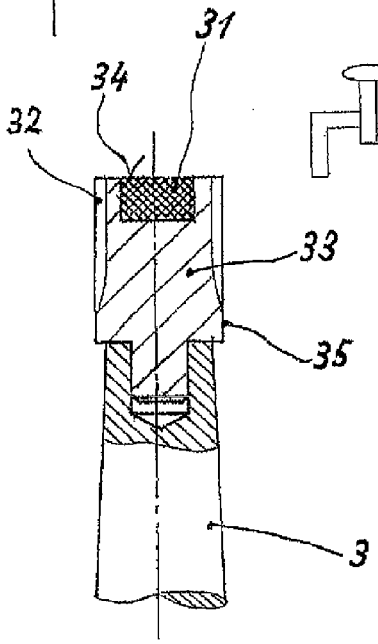

An attachment placed on the spindle 3 has been installed downstream from the thread-guiding device 1 with the twisting element 10. Appropriately, this attachment 33 has a cylindrical mantle for which grooves 32 have been foreseen, and they extend all the way to the front part 34 of the attachment 33. The grooves can have different designs, but it is essential to protect the thread F as it is taken through the grooves. The diameter of the attachment 33 can exceed the subsequent spindle diameter by the groove depth (FIGS. 3 and 4), but it is also practical if the grooves 33 with their groove bottom end on the subsequent spindle diameter (FIGS. 1 and 2) or attachment diameter (FIG. 4) so the thread is protected.

The thread-guiding device 1 has been arranged in such a way over the front part 34 of the attachment 33 that the thread F emerging from the twisting element 10 comes out centrically in front of the front part 34. This results in an exact geometry of the thread F during the transition in the grooves 32 of the attachment 33 independently from the twisting of the spindle 3. The thread F is easily and securely held by the grooves 32 and taken along until the tension in the thread F caused by the traveler 63 left behind becomes so great that it jumps out of the groove 32 into the immediately adjacent groove 32. The pull caused by the traveler 63 left behind increases the tension in the thread F so much that no balloon is formed—instead, the thread F winds around the attachment 33 and the spindle 3 in a spiral way.

Because thread F emerges from the twisting element 10 as a fully twisted thread F and the arrangement of the twisting element 10 over the spindle attachment 33 forces the course of the thread to have a precise geometry, irregular jumps or an irregular catching of the thread F are prevented. The grooves 32 do not even have to be very pronounced and sharp-edged to catch and tightly hold the thread F. As a result of this, the thread is protected and napping is prevented. It has proven practical for the depth of the grooves 32 to be about one-half as great as the width of the grooves 32 so the thread can be lifted out from this groove 32 with only a slight pull. Since the tension jolts and the friction acting on the thread are low, the quality of the thread does not suffer. To prevent large jumps, it is useful to arrange many grooves 32 along the perimeter of the attachment 33, if possible, so the longitudinal differences and the jumps of the thread F are slight.

Figure 6:
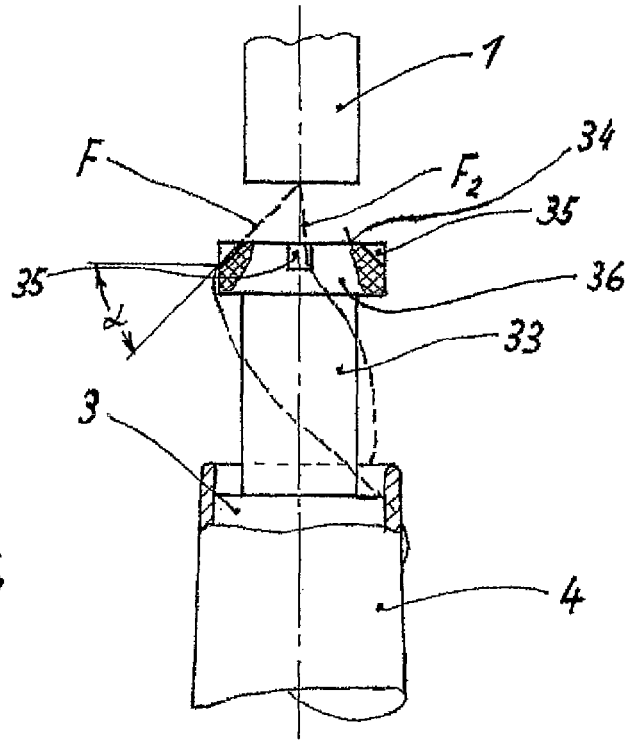
FIG. 6 another embodiment of the spindle attachment.

FIG. 6 shows another embodiment in which the spindle attachment 33, on the end facing the thread-guiding element 1, has a collar 36 with grooves 35 that protrudes from the shaft diameter of the attachment 33. With regard to their orientation and length, the grooves have been adapted to the geometry of the course of the thread. They run inclined towards the turning axis of the attachment 33 and cut through the edge of the collar 36 formed by the front part 34 and the mantle at an angle $\alpha$. This angle $\alpha$ is determined by the centric exiting from the thread-guiding element 1 and the course of the thread, under which the thread F reaches the edge of the collar 36 provided with grooves 35. These grooves 35 have a rectangular cross-section, but they form a triangle in their longitudinal section. The apex of this triangle catches and holds back the thread F guided through the edge. $F_2$ shows another position of the thread F as it runs through the groove 35. This design of the groove 35 allows a controlled—and therefore very uniform—catching and releasing of the thread F so that it is given a uniform twist with hardly any abrasion. The thread F runs out of the groove 35 freely over the shaft of the attachment 33 on the spool 4 and slides down on it towards the traveler device without forming a balloon.

Instead of running through conventional thread guide (pig tail), the fiber composite F' that emerges from the drawing frame runs through a thread-guiding device 1 with a twisting apparatus 10 synchronously moved by the spindle speed, which therefore gives the fiber composite F' a twist. The taking along of the twisting element 10 through the spindle 3 is done by means of a magnetic coupling 1, 10, so that a fully twisted thread F exits the twisting apparatus 10. Immediately after leaving the twisting apparatus 10, this fully twisted thread F is led over a spindle attachment 33 provided with grooves 32, 35. The thread F is caught by the grooves 32, 35 and taken along through the spindle 3 with the spindle twist in front of the traveler 63. Since the traveler 63 is left behind, the known effect takes place, namely that due to the increased tension acting on the thread F, no balloon forms and the spool 4 winds around before it reaches the traveler device and is wound up. Furthermore, the twisting apparatus 10 is equipped with a braking device to dampen and compensate for tension jolts so that they cannot exert an influence on the spinning line between drawing frame outlet and twisting element. The twist provided propagates unhindered and with full force until it reaches the drawing frame outlet. The attachment 33 with grooves 32, 35 has been installed immediately downstream from the twisting element 10. Balloon suppression takes place independently from the twisting process.

The twisting element 10 is aligned exclusively for providing the twist, while the spindle attachment 33 catches a fully twisted thread F that is largely insensitive to being carried away by the grooves 32, 35 that catch it. The spindle attachment 33 and the grooves 32, 35 are only laid out for balloon suppression, in which case the braking device foreseen for the twisting apparatus almost fully compensates for the jolts occurring due to one groove 32, 35 jumping into another one.

The twisting process takes place continuously without interference and occurs almost exclusively in the area between drawing frame outlet and twisting element. The reduction in speed of the thread F in the twisting apparatus 10 plays a decisive role here. The braking device can regulate the tension in the thread and maintain it at an overall low level. The friction strain of the thread F as it passes through the grooves 32, 35 of the spindle attachment 33 is therefore low and thread quality is not affected. The effect of the speed reduction can be regulated by changing the wrap-around angle. A full or half wrap-around turn has proven to be ideal for the strain on the thread F under simultaneous balloon suppression. More details are given in the older application (WO 2004/072339 A1).

The thread is already largely insensitive against this friction strain because a fully twisted thread F emerges from the twisting element 10. Experiments have shown that, compared to a conventional thread guide with which only about 93% of the twist in a finished thread is achieved, when using the twisting element 10 more than 100% of the twist is reached in the region of the spinning triangle. If the spindle attachment 33 is used without twisting element 10, then a twisting jam caused by the friction occurs in the shaft of the spindle 3 and the spindle attachment 33, in which case only 85% of the twisting is available in the region of the spinning triangle. In the past, this led to unacceptable quality losses in the thread—especially when spinning short fiber composites—and to frequent thread breakage.

Figure 5:
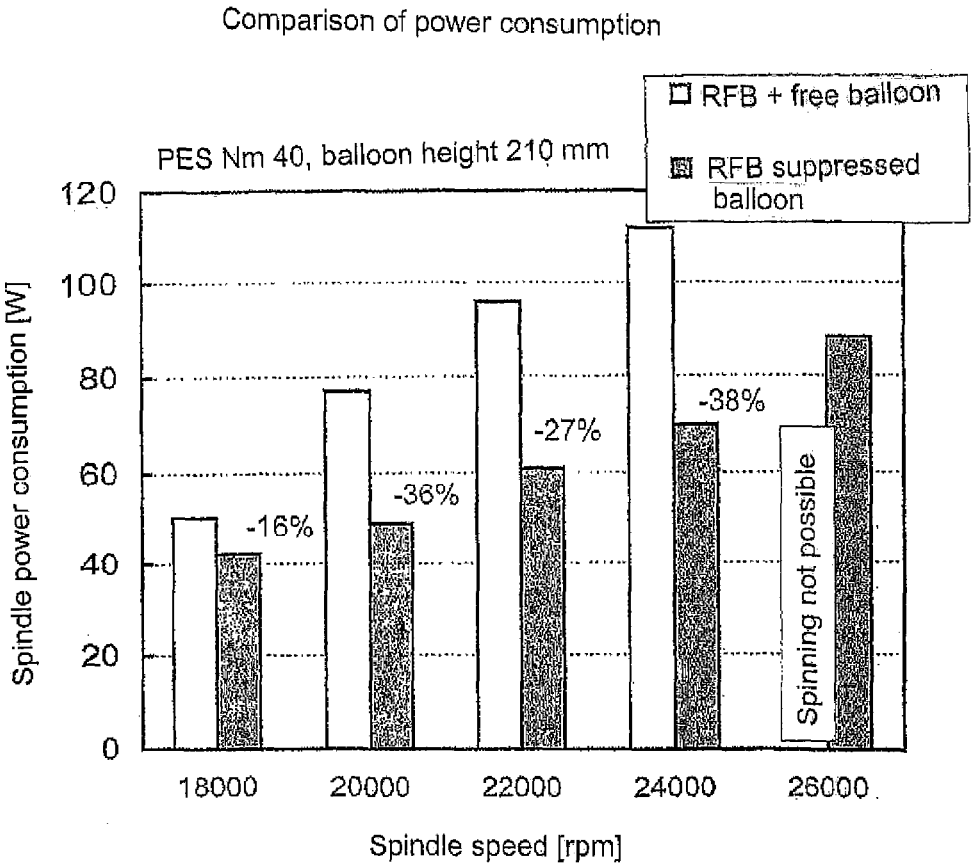
FIG. 5 a comparison of power input with and without spindle attachment.

If work is performed with a grooved spindle attachment 33 in addition to the twisting element 10, then not only a much higher quality and spinning with an almost undamaged thread are achieved, but also much faster speeds. In this case, considerable energy savings in spite of the higher speed are achieved compared with spinning without a spindle attachment. FIG. 5 shows, for example, a comparison of power consumption while spinning a yarn of Nm 40 fineness with a) the twisting element with thread brake but without balloon constriction ring;
b) the twisting element with thread brake and spindle attachment installed downstream (suppressed thread balloon)

As is apparent in the illustration, speeds of 26,000 rpm could be achieved with the spindle attachment 33, whereas spinning without the spindle attachment 33 was impossible. While at 18,000 rpm the power consumption of spindle 3 was lower by 16% when spinning with the spindle attachment 33 than without it, at a speed of 24,000 rpm the difference even amounted to 38%—in other words, as the speed increased, the power requirement dropped very significantly when spinning with the spindle attachment 33 compared to spinning without it. This shows that—especially at higher speeds—the utilization of the spindle attachment installed downstream has a particularly favorable effect on power requirements: When the spinning speed is almost doubled, the energy requirement increases by only 38%. Surprisingly, thread quality does not decrease in this process and spinning takes place almost without thread breakage. Considerable energy savings are achieved with higher production performance and the spinning of short staple fibers with suppressed balloon is made possible without affecting yarn quality.

It should be appreciated by those skilled in the art that various modifications and variations may be made present invention without departing from the scope and spirit of the invention. It is intended that the present invention include such modifications and variations as come within the scope of the appended claims.

The invention claimed is:

1. An apparatus for spinning staple fibers on a ring spindle machine, said apparatus comprising:

a ring spindle disposed downstream of a drawing frame outlet;

a thread guiding device disposed between said drawing frame outlet and said ring spindle, said thread guiding device comprising a twisting apparatus that is magnetically coupled with said ring spindle so as to rotate at the same speed as said ring spindle;

said twisting apparatus further comprising a thread braking device configured along a path of the thread through said twisting apparatus;

an attachment configured at a top of said ring spindle and spaced from said twisting apparatus, said attachment comprising a plurality of circumferential grooves configured to catch the thread coming from said twisting apparatus and being wound onto said ring spindle.

2. The apparatus as in claim 1, wherein said attachment comprises a permanent magnet in a front part thereof that faces said twisting apparatus, said magnet magnetically couples with an opposite magnet in a bottom part of said twisting apparatus.

3. The apparatus as in claim 2, wherein said attachment comprises a cylindrical outer circumferential surface, said grooves defined in said surface so as to extend into said front part of said attachment.

4. The apparatus as in claim 3, wherein a thread path through said thread guiding device is concentric with ring spindle.

5. The apparatus as in claim 2, wherein said attachment comprises a diameter that equals a diameter of the top of said ring spindle to which said attachment is coupled.

6. The apparatus as in claim 2, wherein said attachment comprises a diameter that is greater than a diameter of the top of said ring spindle to which said attachment is coupled.

7. The apparatus as in claim 1, wherein said grooves are defined completely along said attachment such that an end of said grooves is defined by the top of said ring spindle.

8. An apparatus for spinning staple fibers on a ring spindle machine, said apparatus comprising:

a ring spindle disposed downstream of a drawing frame outlet;

a thread guiding device disposed between said drawing frame outlet and said ring spindle, said thread guiding device comprising a twisting apparatus that is magnetically coupled with said ring spindle so as to rotate at the same speed as said ring spindle;

said twisting apparatus further comprising a thread braking device configured along a path of the thread through said twisting apparatus;

an attachment configured at a top of said ring spindle and spaced from said twisting apparatus, said attachment comprising a plurality of circumferential grooves configured to catch the thread coming from said twisting apparatus and being wound onto said ring spindle; and wherein said attachment comprises a circumferential belt area adjacent to said top of said ring spindle, said grooves defined along said attachment such that an end of said grooves said defined by said belt area.

9. An apparatus for spinning staple fibers on a ring spindle machine, said apparatus comprising:

a ring spindle disposed downstream of a drawing frame outlet;

a thread guiding device disposed between said drawing frame outlet and said ring spindle, said thread guiding device comprising a twisting apparatus that is magnetically coupled with said ring spindle so as to rotate at the same speed as said ring spindle;

said twisting apparatus further comprising a thread braking device configured along a path of the thread through said twisting apparatus;

an attachment configured at a top of said ring spindle and spaced from said twisting apparatus, said attachment comprising a plurality of circumferential grooves configured to catch the thread coming from said twisting apparatus and being wound onto said ring spindle; and wherein said attachment comprises a collar configured at an end thereof that is opposite from said thread guiding device, said collar protruding radially from said attachment, said grooves defined in said collar.

10. The apparatus as in claim 9, wherein said grooves are defined into said collar at an angle from the circumference of said collar towards a concentric center of said collar in a direction towards a forward edge of said collar so as to intersect the forward edge of said collar at an angle $\alpha$.

11. The apparatus as in claim 10, wherein said grooves comprise an orientation and length on said attachment that are defined as a function of thread geometry.

12. The apparatus as in claim 11, wherein said grooves comprise a width that is about twice the diameter of the thread.

13. The apparatus as in claim 12, wherein said grooves comprise a depth that is about one-half of said groove width.

14. A method for spinning stable fibers on a ring spinning machine, whereby staple fibers are drawn into a fiber composite in a drawing frame, twisted together to form a thread, and wound up on a spindle by a traveler device, said method comprising:

running the fiber composite from the drawing frame through a thread-guiding device;

imparting a twist to the fiber composite with a twisting device configured with the thread-guiding device, the twisting device driven synchronously with the spindle so that a fully twisted thread emerges from the twist device; and running the twisted thread through a spindle attachment on the spindle, the attachment having grooves that grasp the thread before the thread reaches the traveler device.

15. The method as in claim 14, wherein the thread is guided concentrically out of the twisting device towards the grooves on the spindle attachment, the twisting device being coaxially arranged with the spindle attachment.

16. The method as in claim 14, further comprising reducing the speed of the thread through the twisting device with a brake configured with the twisting device.

17. The method as in claim 15, wherein the speed reduction is controlled in a manner to maintain thread tension at a low level while being able to compensate for thread tension jolts.

18. The method as in claim 14, wherein the number of grooves on the spindle attachment is maximized so that the thread is grasped by as many grooves as possible before running to the traveler device.

* * * * *